US012312939B2

(12) United States Patent
Alquwizani et al.

(10) Patent No.: US 12,312,939 B2
(45) Date of Patent: May 27, 2025

(54) ESP GAS HANDLER DISCHARGE PRESSURE MEASUREMENT AND MONITORING

(71) Applicant: SAUDI ARABIAN OIL COMPANY, Dhahran (SA)

(72) Inventors: Saud A. Alquwizani, Dhahran (SA); Torty C. Kalu-Ulu, Ras Tanura (SA); Cleavant J. Flippin, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/304,496

(22) Filed: Apr. 21, 2023

(65) Prior Publication Data

US 2024/0352848 A1 Oct. 24, 2024

(51) Int. Cl.
*E21B 47/008* (2012.01)
*E21B 43/12* (2006.01)

(52) U.S. Cl.
CPC ..... *E21B 47/008* (2020.05); *E21B 43/128* (2013.01)

(58) Field of Classification Search
CPC ..... E21B 47/008; E21B 43/13; E21B 43/121; E21B 43/122; E21B 43/124; E21B 43/126; E21B 43/127; E21B 43/128; E21B 43/129; E21B 43/123
See application file for complete search history.

(56) References Cited

U.S. PATENT DOCUMENTS

| | | | | |
|---|---|---|---|---|
| 3,887,342 | A * | 6/1975 | Bunnelle | B01D 19/0057 417/313 |
| 9,720,424 | B2 | 8/2017 | Ige et al. | |
| 11,162,340 | B2 | 11/2021 | Xiao et al. | |
| 2009/0250210 | A1* | 10/2009 | Allen | F04D 13/10 702/6 |
| 2020/0072226 | A1* | 3/2020 | Rivera Villarreal | F04D 31/00 |
| 2023/0135161 | A1* | 5/2023 | Loh | E21B 47/06 73/152.51 |

* cited by examiner

*Primary Examiner* — Yanick A Akaragwe
(74) *Attorney, Agent, or Firm* — Osha Bergman Watanabe & Burton LLP

(57) ABSTRACT

A system and method for determining the discharge pressure of a gas handler in a well. The system includes an electrical submersible pump connected to a discharge head disposed in the well, a gas handler discharge line configured to connect the discharge head to a sensor, a processor configured to receive data from the sensor and determine the discharge pressure of the gas handler based on the received data, and a display configured to display the discharge pressure of the gas handler. The method includes attaching a discharge head to the gas handler, attaching a gas handler discharge line from the discharge head to a sensor, measuring pressure transferred from the gas handler into the electrical submersible pump, receiving the measurement of the pressure transferred, determining the discharge pressure of the gas handler based on the measurement of the pressure transferred, and displaying the discharge pressure of the gas handler.

14 Claims, 4 Drawing Sheets

ESP GAS HANDLER DISCHARGE PRESSURE MEASUREMENT AND MONITORING

BACKGROUND

In hydrocarbon well development, it is common practice to use electrical submersible pump systems (ESPs) as a primary form of artificial lift. It is common in the industry to have a means to monitor and measure the ESP fluid discharge pressure and temperature. In high gas volume wells, it is beneficial to measure and monitor the gas handler's discharge pressure transfer to the ESP.

Accordingly, there exists a need for a system for determining a discharge pressure of a gas handler in a well. Advantages of measuring and monitoring the amount of pressure discharged into the ESP includes but is not limited to optimizing performance and improving runlife.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for determining a discharge pressure of a gas handler in a well, the system comprising: an electrical submersible pump connected to a discharge head disposed in the well, wherein the electrical submersible pump comprises a pump discharge line, wherein the discharge head is connected to the gas handler, wherein the gas handler is configured for a fluid to pass through the gas handler to the electrical submersible pump; a gas handler discharge line configured to connect the discharge head to a sensor; wherein the gas handler discharge line is a pressure transfer line from the discharge head to the sensor, wherein the sensor is configured to measure a pressure transferred from the gas handler into the electrical submersible pump; a processor configured to receive data from the sensor and determine the discharge pressure of the gas handler based on the received data; and a display configured to display the discharge pressure of the gas handler.

In one aspect, embodiments disclosed herein relate to a method for determining a discharge pressure of a gas handler in a well, the method comprising: attaching a discharge head to the gas handler disposed in the well, wherein the discharge head is connected to an electrical submersible pump having a pump discharge line; wherein the gas handler is configured for a fluid to pass through the gas handler to the electrical submersible pump; attaching a gas handler discharge line from the discharge head to a sensor; wherein the gas handler discharge line is a pressure transfer line from the discharge head to the sensor, measuring a pressure transferred from the gas handler into the electrical submersible pump, via the sensor; receiving, by a processor, the measurement of the pressure transferred; determining, by the processor, the discharge pressure of the gas handler based on the measurement of the pressure transferred; and displaying, by a display, the discharge pressure of the gas handler.

Other aspects and advantages of the claimed subject matter will be apparent from the following description and the appended claims.

DETAILED DESCRIPTION

Figure 1:
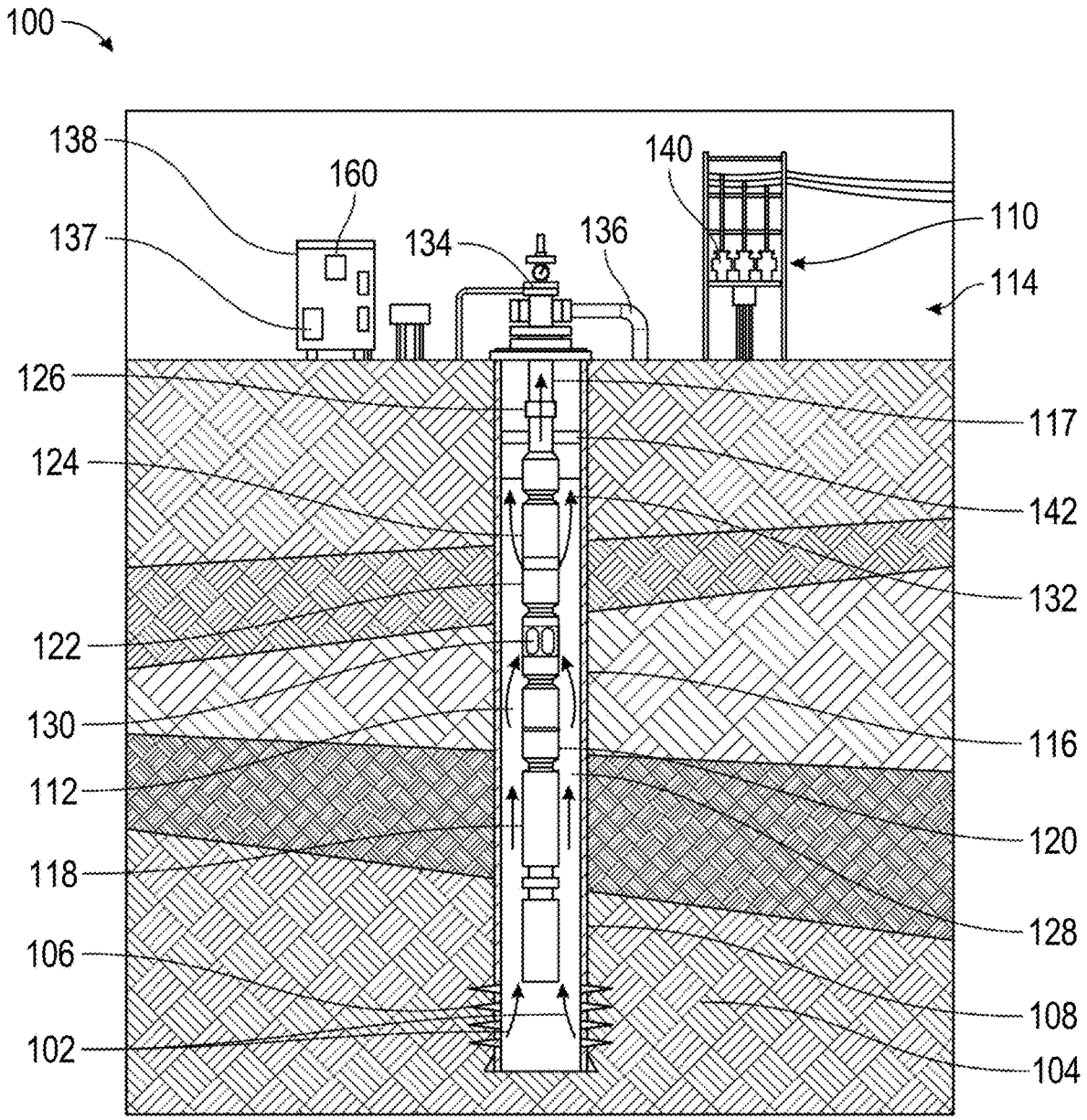
FIG. 1 shows an exemplary well with an Electrical Submersible Pump (ESP) completion design in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a system to measure and monitor the discharge pressure of a gas handler that is transferred to the ESP after gas is comingled into the fluid before entering the pump inlet.

Embodiments of the present disclosure may provide at least one of the following advantages.

FIG. 1 shows an exemplary Electrical Submersible Pump (ESP) system (100). The ESP system (100) is one example of an artificial lift system that is used to help produce fluids (102) from a formation (104). The well (116) may be open hole or include perforations (106). Perforations (106) in the well's (116) casing string (108) provide a conduit for the reservoir fluids (102) to enter the well (116) from the formation (104). An ESP system (100) is an example of the artificial lift system, ESP system and artificial lift system may be used interchangeably within this disclosure. The ESP system (100) includes surface equipment (110) and an ESP string (112). The ESP string (112) is deployed in a well (116) on production tubing (117) and the surface equipment (110) is located on the surface (114). The production tubing (117) extends to the surface (114) and is made of a plurality of tubulars connected together to provide a conduit for reservoir fluids (102) to migrate to the surface (114). The surface (114) is any location outside of the well (116), such as the Earth's surface.

The ESP string (112) may include a motor (118), motor protectors (120), a gas separator (122), a multi-stage centrifugal pump (124) (herein called a "pump" or "ESP"

(124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of reservoir fluids (102) from the bottom of the well (116) to the surface (114). The motor (118) is cooled by the reservoir fluids (102) passing over the motor housing. The motor (118) is powered by the power cable (126). The power cable (126) may also provide power to downhole pressure sensors or onboard electronics that may be used for communication. The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116). The power cable (126) may be a single round power cable.

Motor protectors (120) are located above (i.e., closer to the surface (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from reservoir fluids (102). The seals further equalize the pressure in the annulus (128) with the pressure in the motor (118). The pump intake (130) is the section of the ESP string (112) where the reservoir fluids (102) enter the ESP string (112) from the annulus (128).

The pump intake (130) is located above the motor protectors (120) and below the pump (124). The depth of the pump intake (130) is designed based off of the formation (104) pressure, estimated height of reservoir fluids (102) in the annulus (128), and optimization of pump (124) performance. If the reservoir fluids (102) have associated gas, then a gas separator (122) may be installed in the ESP string (112) above the pump intake (130) but below the pump (124). The gas separator (122) removes the gas from the reservoir fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the reservoir fluids (102) to the surface (114). The pump (124) has a plurality of stages that are stacked upon one another. Each stage contains a rotating impeller and stationary diffuser. As the reservoir fluids (102) enter each stage, the reservoir fluids (102) pass through the rotating impeller to be centrifuged radially outward gaining energy in the form of velocity. The reservoir fluids (102) enter the diffuser, and the velocity is converted into pressure. As the reservoir fluids (102) pass through each stage, the pressure continually increases until the reservoir fluids (102) obtain the designated discharge pressure and has sufficient energy to flow to the surface (114).

A packer (142) is disposed around the ESP string (112). Specifically, the packer (142) may be located above (i.e., closer to the surface (114)) the multi-stage centrifugal pump (124) or downhole from the multi-stage centrifugal pump (124). The packer (142) may be any packer (142) known in the art such as a mechanical packer (142). The packer (142) seals the annulus (128) space located between the ESP string (112) and the casing string (108). This prevents the reservoir fluids (102) from migrating past the packer (142) in the annulus (128).

The number of stages is determined prior to installation based of the estimated required discharge pressure. Over time, the formation (104) pressure may decrease and the height of the reservoir fluids (102) in the annulus (128) may decrease. In these cases, the ESP string (112) may be removed and resized. Once the reservoir fluids (102) reach the surface (114), the reservoir fluids (102) flow through the wellhead (134) into production equipment (136). The production equipment (136) may be any equipment that can gather or transport the reservoir fluids (102) such as a pipeline or a tank.

The remainder of the ESP system (100) includes various surface equipment (110) such as electric drives (137), production controller (138), the control module, and an electric power supply (140). The electric power supply (140) provides energy to the motor (118) through the power cable (126). The electric power supply (140) may be a commercial power distribution system or a portable power source such as a generator. The production controller (138) is made up of an assortment of intelligent unit-programmable controllers and drives which maintain the proper flow of electricity to the motor (118) such as fixed-frequency switchboards, soft-start controllers, and variable speed controllers. The production controller (138) may be a variable speed drive (VSD), well choke, inflow control valve, and/or sliding sleeves. The production controller (138) is configured to perform automatic well operation adjustments. The electric drives (137) may be variable speed drives which read the downhole data, recorded by a sensor, and may scale back or ramp up the motor (118) speed to optimize the pump (124) efficiency and production rate. The electric drives (137) allow the pump (124) to operate continuously and intermittently or be shut-off in the event of an operational problem. The production controller (138) may include a display (160). The display (160) may be used to display sensor measurements.

Figure 2:
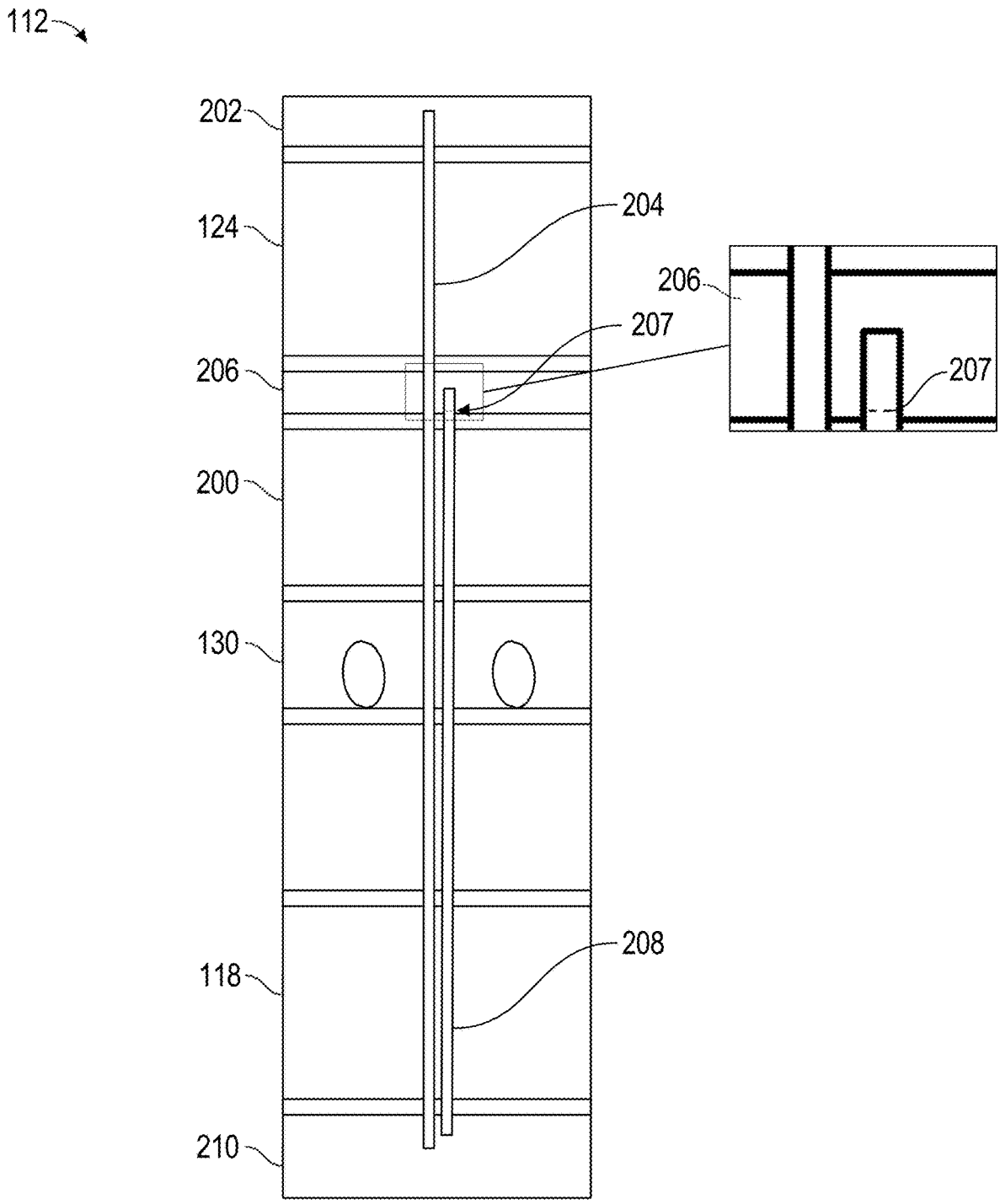
FIG. 2 shows a system in accordance with one or more embodiments.

FIG. 2 shows a system in accordance with one or more embodiments. Specifically, FIG. 2 shows an example ESP string (112) including a gas handler (200). A gas handler (200) may be configured for fluid (102) to pass through and into the pump (124). The gas handler (200) may combine gas and fluid (102) into a homogenized mixture to stabilize ESP system (100) operation. The gas handler (200) may be located downhole from the ESP (124). The gas handler (200) may be located uphole from a gas separator (122). The gas handler (200) may be located uphole from the motor (118) and pump intake (130).

A discharge head (206) for the gas handler (200) may be connected to the inlet of the ESP (124) in the well (116). The ESP (124) may include a pump discharge line (204). The discharge head (206) may be connected to the gas handler (200). The discharge head (206) of the gas handler (200) may be a bolt-on type or integral type to the gas handler (200). The discharge head (206) may include a plurality of ports (207). Each of the ports (207) may have a range of depth from 1.4 inches to 2.4 inches. Dependent on the type of discharge head (206), the ports (207) may be positioned at an angle of about 60 degrees to a top horizontal connection flange on the discharge head (206). The angle of the ports (207) may aide in an easy and secure termination of the gas handler discharge line (208). A gas handler discharge line (208) may connect the discharge head (206) to a sensor (210).

In other embodiments, sensors (210) may be installed in various locations along the ESP string (112) to gather downhole data such as pump intake volumes, discharge pressures, shaft speeds and positions, and temperatures. The sensor (210) may measure a pressure transferred from the gas handler (200) into the ESP (124). The gas handler discharge line (208) may be a pressure transfer line from the discharge head (206) to the sensor (210). The gas handler (200) discharge pressure may be measured by the connection of the gas handler discharge line (208) from the discharge head (206) to the sensor (210). The gas handler discharge line (208) may terminate into the ports (207) provided on the discharge head (206) and sensor (210). The gas handler discharge line (208) may be pre-filled with a fluid having a known density. The gas handler discharge line (208) may include a ferrule inserted at the end of each port in the discharge head (206). The gas handler (200) discharge pressure measurement may be digitally transmitted using an ESP (124) monitoring tool such as the sensor (210) and the power cable (126). The power cable (126) may be configured to transfer a plurality of waves. The captured discharge pressure may be available for readout and displayed using the display (160). The display (160) may be on the production controller (138).

In some embodiments, the sensor (210) communicates with the production controller (138) on surface (114). For example, the sensor (210) collects waves that are transduced from the discharge head (206) to a surface readout panel, such as the display (160) on the production controller (138). The sensor (210) may be equipped with microcontroller emitters configured to receive data from the sensor (210) and communicate. A voltage-current converter may be connected to a three-phase neutral point on the motor (118). At the neutral point, a direct current (DC) signal may be injected by the sensor (210) through the microcontroller emitters and voltage-current converter. The injected DC signal flows over the power cable (126) to the surface (114). On surface (114), the surface equipment (110) may include a three-phase choke panel to prevent high-voltage alternating current (AC) from reaching the production controller (138) while allowing DC signals to pass. A Y-Connection inductive filter may be utilized to act as an interface for withdrawing the DC signal and removing any signals at a fundamental frequency. The sensor (210) may be designed as a form of current sink to allow current to flow through the sensor (210). The sensor (210) retrieves the DC power from the three-phase motor neutral-point and modulates the current signal. Once received on surface, the production controller (138) may then determine the downhole conditions by detecting and measuring the modulated current signal from the sensor (210).

Impellers keyed to a common shaft in the ESP (124) may add to lifting pressure as the impellers allow fluid passage from one stage to another. The gas handler (200) installed in the ESP string (112) may condition the fluid (102) before reaching the ESP (124) to avoid gas-locking of the impeller eyes in high gas volume fraction wells (116). The impeller eye is a low-pressure region in the center of the impeller. High gas volume fluid flowing into ESP (124) impellers may result in cavitation and gas-locking. For example, if the impellers gas-lock, the ESP (124) may seize to produce as designed. Severe gas-lock may lead to de-completion of the well (116). In one or more embodiments, the gas handler (200) discharge pressure may be equal to pump intake pressure. Pump intake pressure measurements may aide in more accurate usage of pump curves to estimate fluid rate passing through the ESP (124). Accurate pump curves may assess ESP system (100) performance.

Figure 3:
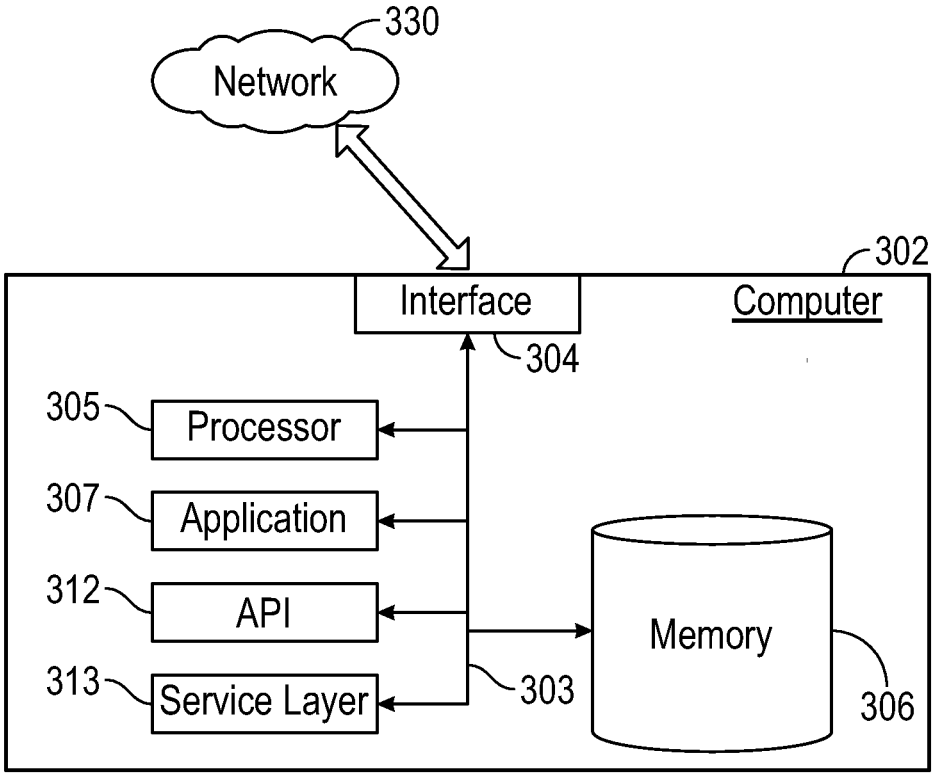
FIG. 3 shows a computer system in accordance with one or more embodiments.

FIG. 3 shows a computer system (302) in accordance with one or more embodiments. Specifically, FIG. 3 shows a block diagram of a computer (302) system used to provide computational functionalities associated with described algorithms, methods, functions, processes, flows, and procedures as described in the instant disclosure, according to an implementation. The illustrated computer (302) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (302) may include a computer that includes an input device, such as a keypad, keyboard, touch screen, or other device that can accept user information, and an output device that conveys information associated with the operation of the computer (302), including digital data, visual, or audio information (or a combination of information), or a GUI.

The computer (302) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (302) may be configured to operate within environments, including cloud-computing-based, local, global, or other environment (or a combination of environments).

At a high level, the computer (302) is an electronic computing device operable to receive, transmit, process, store, or manage data and information associated with the described subject matter. According to some implementations, the computer (302) may also include or be communicably coupled with an application server, e-mail server, web server, caching server, streaming data server, business intelligence (BI) server, or other server (or a combination of servers).

The computer (302) can receive requests over network (330) from a client application (for example, executing on another computer (302)) and responding to the received requests by processing the said requests in an appropriate software application. In addition, requests may also be sent to the computer (302) from internal users (for example, from a command console or by other appropriate access method), external or third-parties, other automated applications, as well as any other appropriate entities, individuals, systems, or computers.

Each of the components of the computer (302) can communicate using a system bus (303). In some implementations, any, or all of the components of the computer (302), both hardware or software (or a combination of hardware and software), may interface with each other or the interface (304) (or a combination of both) over the system bus (303) using an application programming interface (API) (312) or a service layer (313) (or a combination of the API (312) and service layer (313). The API (312) may include specifications for routines, data structures, and object classes. The API (312) may be either computer-language independent or dependent and refer to a complete interface, a single function, or even a set of APIs. The service layer (313) provides software services to the computer (302) or other components (whether or not illustrated) that are communicably coupled to the computer (302).

The functionality of the computer (302) may be accessible for all service consumers using this service layer. Software services, such as those provided by the service layer (313), provide reusable, defined business functionalities through a defined interface. For example, the interface may be software written in JAVA, C++, or other suitable language providing data in extensible markup language (XML) format or other suitable format. While illustrated as an integrated component of the computer (302), alternative implementations may illustrate the API (312) or the service layer (313) as stand-alone components in relation to other components of the computer (302) or other components (whether or not illustrated) that are communicably coupled to the computer (302). Moreover, any or all parts of the API (312) or the service layer (313) may be implemented as child or sub-modules of another software module, enterprise application, or hardware module without departing from the scope of this disclosure.

The computer (302) includes an interface (304). Although illustrated as a single interface (304) in FIG. 3, two or more interfaces (304) may be used according to particular needs, desires, or particular implementations of the computer (302). The interface (304) is used by the computer (302) for communicating with other systems in a distributed environment that are connected to the network (330). Generally, the interface (304) includes logic encoded in software or hardware (or a combination of software and hardware) and operable to communicate with the network (330). More specifically, the interface (304) may include software supporting one or more communication protocols associated with communications such that the network (330) or interface's hardware is operable to communicate physical signals within and outside of the illustrated computer (302).

The computer (302) includes at least one computer processor (305). Although illustrated as a single computer processor (305) in FIG. 3, two or more processors may be used according to particular needs, desires, or particular implementations of the computer (302). Generally, the computer processor (305) executes instructions and manipulates data to perform the operations of the computer (302) and any algorithms, methods, functions, processes, flows, and procedures as described in the instant disclosure.

The computer (302) also includes a non-transitory computer (302) readable medium, or a memory (306), that holds data for the computer (302) or other components (or a combination of both) that can be connected to the network (330). For example, memory (306) can be a database storing data consistent with this disclosure. Although illustrated as a single memory (306) in FIG. 3, two or more memories may be used according to particular needs, desires, or particular implementations of the computer (302) and the described functionality. While memory (306) is illustrated as an integral component of the computer (302), in alternative implementations, memory (306) can be external to the computer (302).

The application (307) is an algorithmic software engine providing functionality according to particular needs, desires, or particular implementations of the computer (302), particularly with respect to functionality described in this disclosure. For example, application (307) can serve as one or more components, modules, applications, etc. Further, although illustrated as a single application (307), the application (307) may be implemented as multiple applications (307) on the computer (302). In addition, although illustrated as integral to the computer (302), in alternative implementations, the application (307) can be external to the computer (302).

Figure 4:
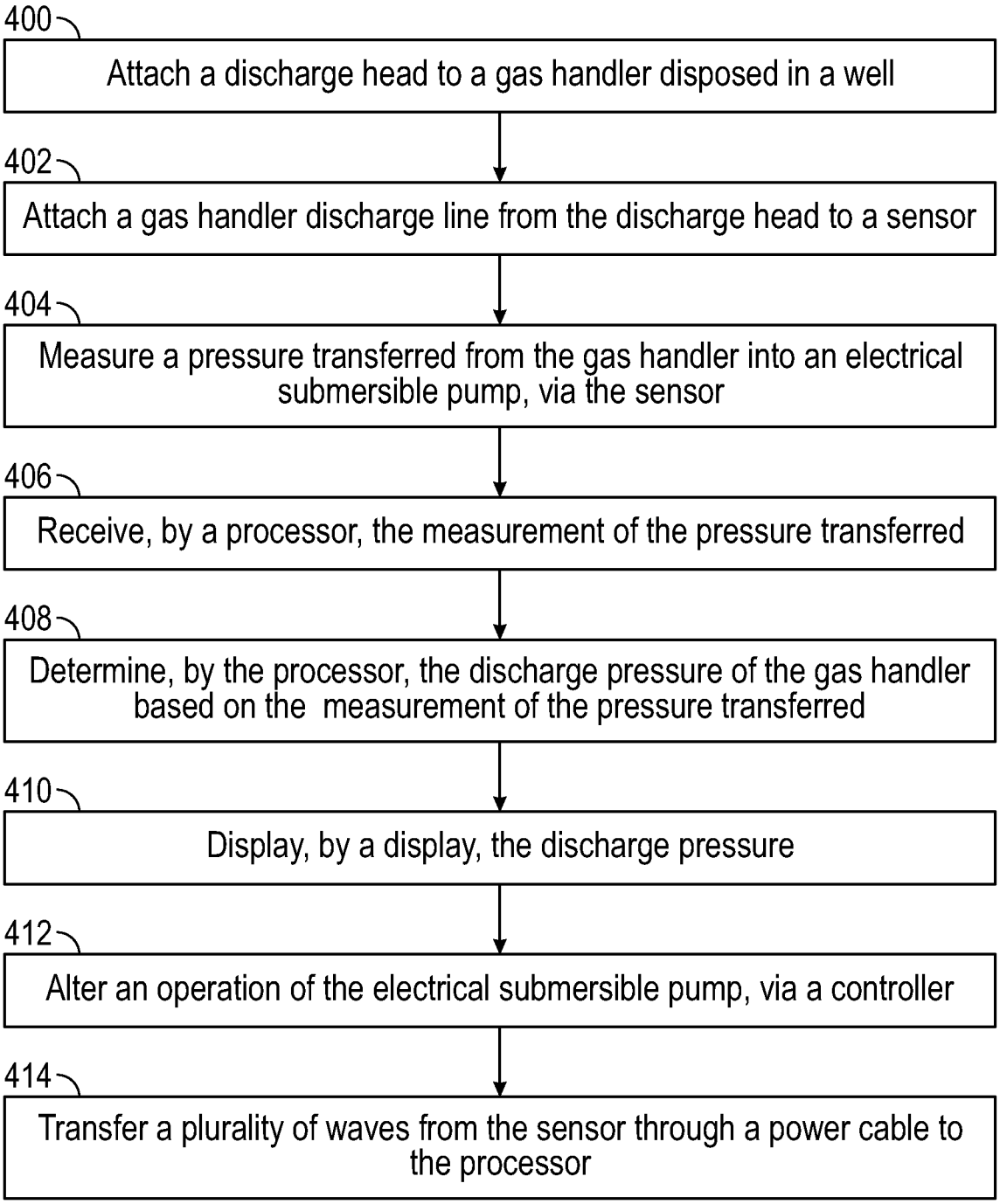
FIG. 4 shows a flowchart in accordance with one or more embodiments.

FIG. 4 shows a flowchart in accordance with one or more embodiments. FIG. 4 shows a method for determining a discharge pressure of a gas handler (200) in a well (116). One or more blocks in FIG. 4 may be performed by one or more components described in FIGS. 1-3. While the various blocks in FIG. 4 are presented and described sequentially, one of ordinary skill in the art will appreciate that some or all blocks may be executed in different orders, may be combined or omitted, and some or all of the blocks may be executed in parallel. Furthermore, the blocks may be performed actively or passively.

In Block 400, a discharge head (206) is attached to a gas handler (200) disposed in a well (116). The discharge head (206) may be connected to an ESP (124) having a pump discharge line (204). The discharge head (206) may be a bolt-on type or an integral type to the gas handler (200). The gas handler (200) may be configured for a fluid to pass through the gas handler (200) to the ESP (124). Gas and liquid may be comingled by the gas handler (200). In Block 402, a gas handler discharge line (208) is attached from the discharge head (206) to a sensor (210). The gas handler discharge line (208) may be a pressure transfer line from the discharge head (206) to the sensor (210). The discharge head (206) may include a plurality of ports. The gas handler discharge line (208) may be terminated into the ports. The ports may comprise a depth in the range of 1.4 inches to 2.4 inches. The gas handler discharge line (208) may include a ferrule inserted at the end of each of the ports. The gas handler discharge line (208) may be pre-filled with a fluid having a known density.

In Block 404, pressure transferred from the gas handler (200) into the ESP (124) is measured via the sensor (210). In Block 406, the measurement of the pressure transferred is received by a processor (305). In Block 408, the discharge pressure of the gas handler (200) is determined, by the processor (305), based on the measurement of the pressure transferred. The processor (305) may be configured to receive data from the sensor (210) and determine the discharge pressure based on received data. In Block 410, the discharge pressure of the gas handler (200) is displayed by a display (160). The display (160) may be on a computer (302) or a production controller (138). In Block 412, an operation of the ESP (124) is altered, via a production controller (138), based, at least in part, on the discharge pressure. In Block 414, a plurality of waves from the sensor (210) are transferred through a power cable (126) to the processor (305). The measured discharge pressure may be transferred to the sensor (210) where the waves are transduced and transferred to the surface (114) for digital readout through the power cable (126) for real-time monitoring and performance optimization.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed is:

1. A system for determining a discharge pressure of a gas handler in a well, the system comprising:

an electrical submersible pump connected to a discharge head disposed in the well, wherein the electrical submersible pump comprises a pump discharge line, wherein the discharge head is connected to the gas handler, wherein the gas handler is configured for a fluid to pass through the gas handler to the electrical submersible pump;

a gas handler discharge line configured to connect the discharge head to a sensor;

wherein the gas handler discharge line is a pressure transfer line from the discharge head to the sensor, wherein the sensor is configured to measure a pressure transferred from the gas handler into the electrical submersible pump;

a processor configured to receive data from the sensor and determine the discharge pressure of the gas handler based on the received data; and a display configured to display the discharge pressure of the gas handler, wherein the gas handler discharge line is terminated into a plurality of ports in the discharge head.

2. The system of claim 1, further comprising:

a controller configured to alter an operation of the electrical submersible pump based, at least in part, on the discharge pressure.

3. The system of claim 1, wherein the gas handler is configured to comingle a gas and a liquid.

4. The system of claim 1, further comprising:

a power cable configured to transfer a plurality of waves from the sensor to the processor.

5. The system of claim 1, wherein each of the plurality of ports comprises a depth of 1.4 inches to 2.4 inches.

6. The system of claim 1, wherein the gas handler discharge line is pre-filled with a fluid having a known density.

7. The system of claim 1, wherein the discharge head is an integral type to the gas handler.

8. A method for determining a discharge pressure of a gas handler in a well, the method comprising:

attaching a discharge head to the gas handler disposed in the well, wherein the discharge head is connected to an electrical submersible pump having a pump discharge line;

wherein the gas handler is configured for a fluid to pass through the gas handler to the electrical submersible pump;

attaching a gas handler discharge line from the discharge head to a sensor;

wherein the gas handler discharge line is a pressure transfer line from the discharge head to the sensor, terminating the gas discharge line into a plurality of ports in the discharge head;

measuring a pressure transferred from the gas handler into the electrical submersible pump, via the sensor;

receiving, by a processor, the measurement of the pressure transferred;

determining, by the processor, the discharge pressure of the gas handler based on the measurement of the pressure transferred; and displaying, by a display, the discharge pressure of the gas handler.

9. The method of claim 8, further comprising:

altering an operation of the electrical submersible pump, via a controller, based, at least in part, on the discharge pressure.

10. The method of claim 8, further comprising:

transferring a plurality of waves from the sensor through a power cable to the processor.

11. The method of claim 8, further comprising:

comingling a gas and a liquid, via the gas handler.

12. The method of claim 8, wherein the plurality of ports comprise a depth of 1.4 inches to 2.4 inches.

13. The method of claim 8, wherein the gas handler discharge line is pre-filled with a fluid having a known density.

14. The method of claim 8, wherein the discharge head is an integral type to the gas handler.

* * * * *